US006089161A

United States Patent [19]

Saban

[11] Patent Number: 6,089,161

[45] Date of Patent: Jul. 18, 2000

[54] METHOD AND APPARATUS FOR TRANSPORTING RAILWAY TRACK SECTIONS

[76] Inventor: John M. Saban, 921 Hober Ave., McKees Rocks, Pa. 15136

[21] Appl. No.: 09/021,647

[22] Filed: Feb. 10, 1998

[51] Int. Cl.[7] ..... E01B 7/08

[52] U.S. Cl. ..... 104/2; 104/3; 104/5; 104/7.1

[58] Field of Search ..... 104/2, 3, 5, 7.1

[56] References Cited

U.S. PATENT DOCUMENTS

| | | | |
|---|---|---|---|
| 3,654,868 | 4/1972 | Plasser et al. | 104/2 |
| 4,261,264 | 4/1981 | Theurer et al. | 104/6 |
| 4,608,928 | 9/1986 | Theurer et al. | 104/3 |
| 4,773,332 | 9/1988 | Theurer et al. | 104/3 |
| 4,784,063 | 11/1988 | Theurer et al. | 104/3 |

*Primary Examiner*—Jesus D. Sotelo
*Assistant Examiner*—Robert J. McCarry, Jr.
*Attorney, Agent, or Firm*—Andrew J. Cornelius

[57] ABSTRACT

A railway panel transport apparatus for moving prefabricated railway panels to installation sites includes a plurality of ties, a first rail, and a second rail. The ties are positioned in spaced parallel relation to support the first and second rails, which extend substantially the length of the railway panel. At least two truck assemblies are connected to the railway panel. The truck assemblies include a pair of travel wheels mounted thereon for engaging and traveling upon existing railway sections. Following transport to the installation site, the truck assemblies are removed and the railway panel is installed in a proper location.

16 Claims, 3 Drawing Sheets

METHOD AND APPARATUS FOR TRANSPORTING RAILWAY TRACK SECTIONS

BACKGROUND OF THIS INVENTION

The present invention relates to a transport apparatus, and, more particularly, to an apparatus that is used to transport prefabricated sections of railway track to an installation site.

During the repair of worn railroad tracks, it is necessary to replace worn or damaged sections of track with new sections. This operation requires that the old section be removed and that the area be excavated to prepare for new ballast and the new track section. It is well known in the art to remove the old section of track and build the replacement section in place. This requires the setting and spacing of a plurality of railroad ties and the timely fastening of the rails to these ties.

This method of track replacement is very time consuming and in most instances it is desirable to minimize the time during which the affected section of track is out of working condition. Maximizing the time during which the track can be used subsequently maximizes the efficiency of the railroad's operation.

Frequently, as a result of terrain requirements and route design, railway track runs through tight places where the accessibility necessary to fabricate rail sections is either poor or nonexistent. For example, a single track road crossing in an urban environment provides for very little access for fabrication. Likewise, right-of-ways granted to public transportation, although generally of a double track configuration, are often cramped, leaving no room for maneuvering or storage of fabricated sections.

In furtherance of this goal it is known to fabricate replacement sections of track off-site and to transport the sections to the site for installation. If the fabrication site is dose to the installation site, it is sometimes possible to convey the panel into position manually. Otherwise, the panels must be transported from the fabrication site to the installation site. In these situations, following off-site fabrication, a crane is utilized to load the section of track onto a flat bed rail car. The flat car is then taken by a locomotive to the installation site where a second crane is used to position the section of track into the excavated area.

The use of large cranes at both the fabrication site and the installation site greatly increases the expense of the operation. Also, in many instances, the cranes themselves are too large to maneuver them easily to the installation point. The use of a locomotive to transport the flat car also increases costs.

Therefore, there is a need for an apparatus for transporting prefabricated sections of railway track to an installation site without the need for cranes, locomotives or other costly transport vehicles.

There is a further need for a transport apparatus which can be run on both rail and non-rail surfaces for facilitating the movement of the prefabricated section into positions required for installation.

SUMMARY OF THE INVENTION

The present invention provides apparatus for transporting railway panel sections that includes a railway panel having a plurality of ties, a first rail, and a second rail, the first and second rails being fastened to the top of the ties in spaced parallel relation to each other, at least one truck assembly, apparatus for mounting the truck assembly to the railway panel, and first and second rail travel wheels being mounted to the truck assembly, the travel wheels projecting below the railway panel and positioned to align with and roll along an existing railway track to permit the assembly to roll therealong.

The present also provides an apparatus for transporting railway panel sections including a railway panel having a plurality of ties, a first rail, and a second rail. The ties are positioned in spaced parallel relationship for supporting the first and second rails. Preferably, the first and second rails extend substantially the length of the railway panel, and the first and second rails are fastened to the top of the ties in spaced parallel relation substantially perpendicular to the ties. The transport apparatus includes at least one, but preferably two, truck assembly. Also included are means for connecting the truck assembly to the railway panel. Each truck assembly has rotatably mounted first and second travel wheels. The travel wheels project below the railway panel. The first and second travel wheels are positioned to align with the first and second rails, respectively, to allow the railway panel to be transported upon an existing railway track.

Further in accordance with the present invention there is provided a method for installing prefabricated railway panels which including the steps of aligning a plurality of ties in a spaced parallel relationship to form a railway panel. A first rail is fastened perpendicular to the top of the ties. A second rail is fastened to the top of the ties in spaced parallel relationship to the first rail. At least one, but preferably two, truck assembly is mounted to the railway panel. A pair of travel wheels are rotatably mounted to each truck assembly to extend below the railway panel in vertical alignment with the first and second rails, respectively. The travel wheels are positioned on a section of existing track. The railway panel is transported to an installation point. The railway panel is jacked up, the truck assemblies are removed, and the railway panel is lowered into an installed position.

Accordingly, a principal object of the present invention is to provide a method and apparatus for transporting a prefabricated section of railway track to an installation point along existing railway track.

An additional object of the present invention is to provide a railway panel transport device which can be used on both existing railway track as well as other travel surfaces.

These and other objects of the present invention will be more completely disclosed and described in the following specification, the accompanying drawings and the appended claims.

DETAILED DESCRIPTION OF THE PREFERRED EMBODIMENT

Figure 1:
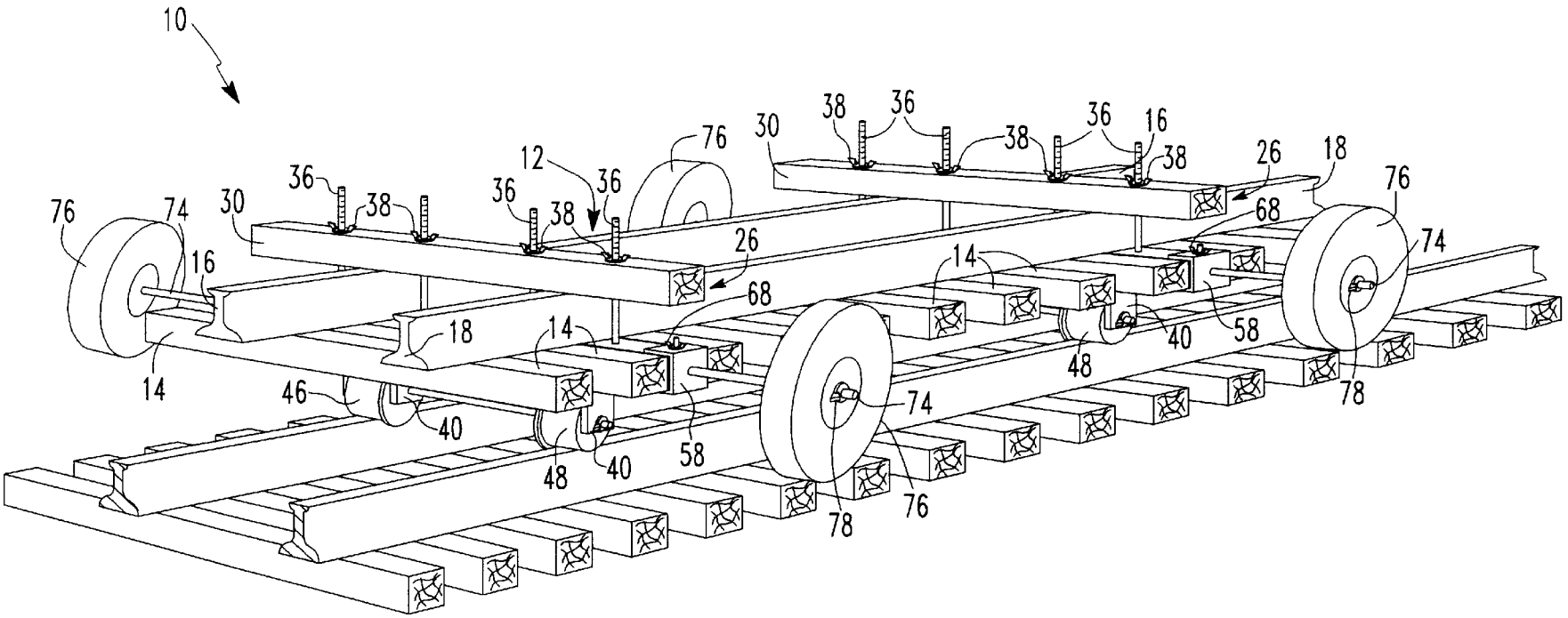
FIG. 1 is a perspective view of the railway panel transport apparatus provided by the present invention.
Figure 2:
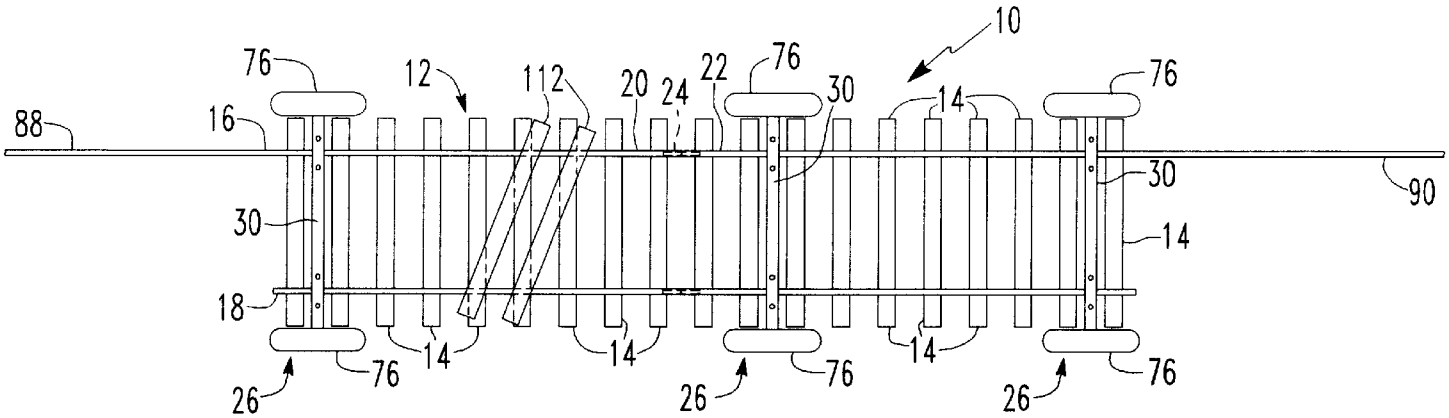
FIG. 2 is a top plan view of a railway panel transport apparatus provided by the present invention.

Referring to the drawings and particularly to FIGS. 1 and 2, there is illustrated a railway panel transport apparatus generally designated by the numeral 10 having a railway panel 12. Apparatus 10 is used to transport panel 12 to the site at which the panel will be installed in the railway. Apparatus 10 is adapted to travel along existing rail lines, or on any other negotiable surface. Apparatus 10 can be moved along an existing rail line with any suitable known construction vehicle or machine that is equipped with rail wheels to permit it to travel over the rail line, and that is sufficiently powered to permit it to push or pull apparatus 10. Apparatus 10 can be moved over any other negotiable surface by any suitable land vehicle or machine that is sufficiently powered. If the distance to be traveled, whether by rail or otherwise, is short enough, manpower can be used to push or pull apparatus 10.

Railway panel 12 includes a plurality of parallel spaced ties 14. First rail 16 and second rail 18 are fastened perpendicular to ties 14 in a spaced parallel relationship in the manner usually employed to mount rails to ties in the railway industry. The space between rails 16 and 18 is determined by the width between the wheels of the vehicles designed to be transported upon the railway panel, once installed. Second rail 18 consists of a single piece of rail material, whereas first rail 16 is made up of two separate pieces 20 and 22, joined together at bar joint 24. In many instances bar joint 24 is replaced by welding the two rail pieces 20 and 22 together. Although not specifically illustrated, it is also possible to manufacture prefabricated railway panels which utilize more than two joined pieces of rail.

Railway panel 12 is shown mounted onto three trucks 26, though the number of trucks 26 actually used will be dependent upon the size and length of the railway panel 12 to be installed. Each of 26 includes a plurality of wheels (specifically discussed below) that allow the railway panel 12 to be transported in a variety of manners.

Figure 4:
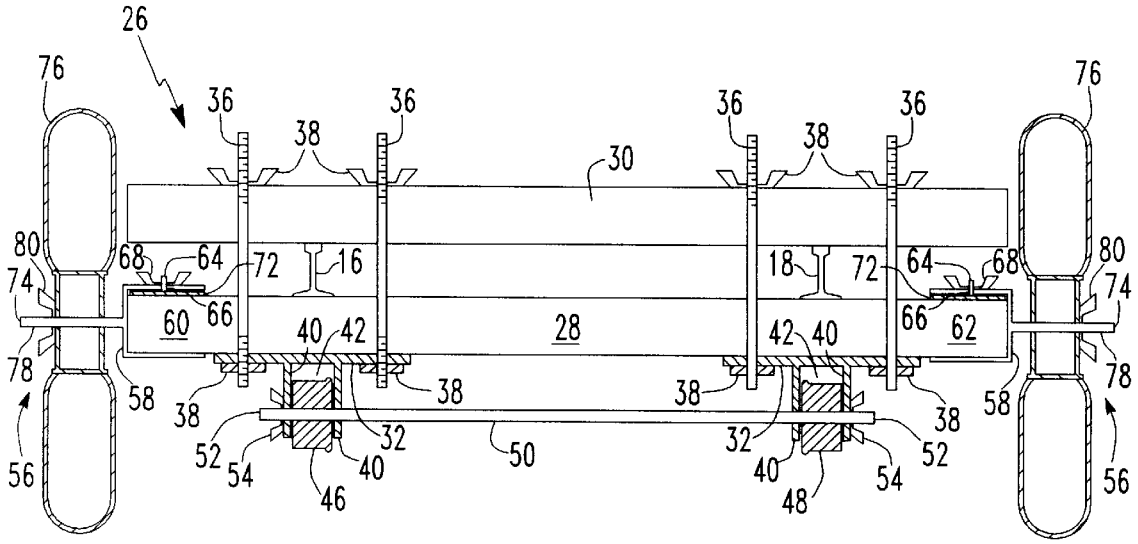
FIG. 4 is a front elevational view, partially in section, of the railway panel transport apparatus shown in FIG. 1.

Referring now to FIG. 4, each truck 26 includes truck tie 28, and clamping tie 30. Truck tie 28 and clamping tie 30 may be made of timber or a manufactured hollow square, or rectangular tube. Truck tie 28 is positioned between a pair of ties 14 and clamping tie 30 is positioned on rails 16 and 18 in vertical, parallel alignment to truck tie 28. Both truck tie 28 and clamping tie 30 are removed from railway panel 12 following transport and prior to installation.

Travel wheel brackets 32 are positioned beneath truck tie 28 and are mounted with bolts 36 extending through holes drilled in clamping tie 30, and truck tie 28. Welds, (not shown) adjoin travel wheel brackets 32 to truck tie 28 at approximately right angles to secure the joining of these possibly uneven surfaces. The welds are preferably single or double fillet welds. Bolts 36 and corresponding nuts 38 are of a coarse thread, preferably a translational thread, preferably an Acme thread, to allow easy loosening and tightening and repeated adjusting. Travel wheel brackets 32 include depending arm members 40 defining spaces 42 therebetween. Spaces 42 are vertically aligned with rails 16 and 18, respectively. Travel wheels 46 and 48 are positioned in spaces 42 and are mounted in travel wheel brackets 32 by a single axle 50. Axle 50 extends between and through depending arm members 40 of travel wheel brackets 32. Axle 50 includes ends 52 having a coarse thread, preferably a translational thread, preferably an Acme thread Corresponding nuts 54 are threaded onto each end 52 of axle 50 to secure travel wheels 46 and 48 in travel wheel brackets 32. It should be understood that travel wheels 46 and 48 include bearings (not shown) which facilitate the rotation of the travel wheels 46 and 48 about the axle 50.

Travel wheels 46 and 48 are designed to allow railway panel 12 to be transported along existing railway tracks. To allow transport of railway panel 12 along other surfaces, mounting wheel assemblies, generally designated by the numeral 56, are utilized on trucks 26. As can be seen in FIG. 4, mounting wheel assemblies 56 include a pair of axle clamps 58 mounted onto opposite ends 60 and 62 of truck tie 28. Axle clamps 58 are of a generally box-shaped configuration which substantially fits the dimensions of truck tie ends 60 and 62. Axle clamps 58 are clamped into rigid is relationship with truck tie ends 60 and 62 by clamp screws 64. Welds (not shown) are configured to allow axle clamps 58 to be adjoined with truck tie ends 60 and 62 at approximately right angles to secure the joining of these possibly uneven surfaces. The welds are preferably single or double fillet welds. Clamp screws 64 include threaded portions 66 rigidly depending from U-shaped tightening portions 68. Threaded portions 66 extend through correspondingly threaded holes 70 in axle clamps 58 into contact with pressure plates 72 positioned between the upper surfaces of truck tie ends 60 and 62 and the inside surfaces of the upper portion of axle clamps 58. Pressure plates 72 spread the pressure of the clamping screw across a larger span of wood in truck tie 28. Upon rotation of tightening portions 68 axle clamps 58 are clampingly engaged to truck tie ends 60 and 62.

It should be understood that FIG. 4, for the sake of clarity, illustrates only the top and bottom flanges on axle clamp 58. Axle clamp 58 could also include front and back flanges including a clamping screw and a pressure plate in order to further clamp the axle clamp 58 to the truck tie 28. Such a configuration would apply clamping pressure transverse to the above described clamping pressure, thereby increasing the degree of engagement between truck tie 28 and axle clamp 58

As seen in FIG. 4, axle clamps 58 include unitary axles 74 that extend longitudinally outwardly from truck tie 28 to which mounting wheels 76 are mounted. Each of wheels 76 can be any suitable wheel, but is preferably a wheel that is suitable for traveling over fairly rough terrain. For example, typical calcium filled construction-type tires would be suitable. Wheels 76 include bearings (not shown) and are rotationally mounted onto axles 74. The bearings are located in the center of the mounting wheels 76 and facilitate rotation of the wheels about the axles. Axles 74 include coarsely threaded end portions 78 upon which corresponding axle nuts 80 are threaded following the attachment of mounting wheels 76. Subsequent tightening of axle nuts 80 secures mounting wheels 76 into operational position.

Figure 5:
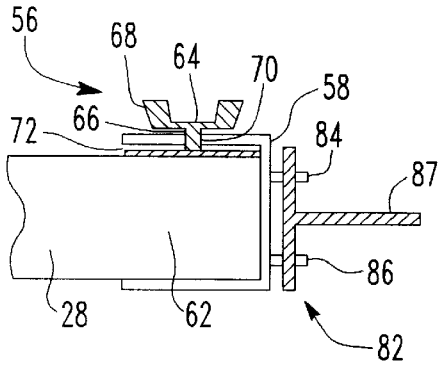
FIG. 5 is a front sectional view of the end portion of a tie used to support a mounting wheel assembly, illustrating the supportive king pin embodiment.

In some circumstances, such as long distance traveling, or travel over rough terrain, it is desirable to improve the steering ability of the mounting wheel assemblies 56. As shown in FIG. 5, this improvement is accomplished by a king pin arrangement generally designated by the numeral 82. In this arrangement, axles 74 (not shown here, but see FIG. 4) do not extend directly from axle clamps 58. Instead, axle clamp 58 is given the arrangement illustrated in FIG. 5 which includes a plurality of short, threaded bolts 84, 86 extending parallel to truck tie 28 in spaced parallel relationship to each other. A generally T-shaped kingpin 87 replaces axle 74. Kingpin 87 is mounted to bolts 84 and 86 with corresponding nuts (not shown) and extends parallel to the truck tie 28 thereby forming an axle for mounting wheels 76.

This arrangement substantially decreases the length of axles, thereby reducing the stress the axles must withstand and improving the steering ability of the mounting wheel assemblies.

Figure 3:
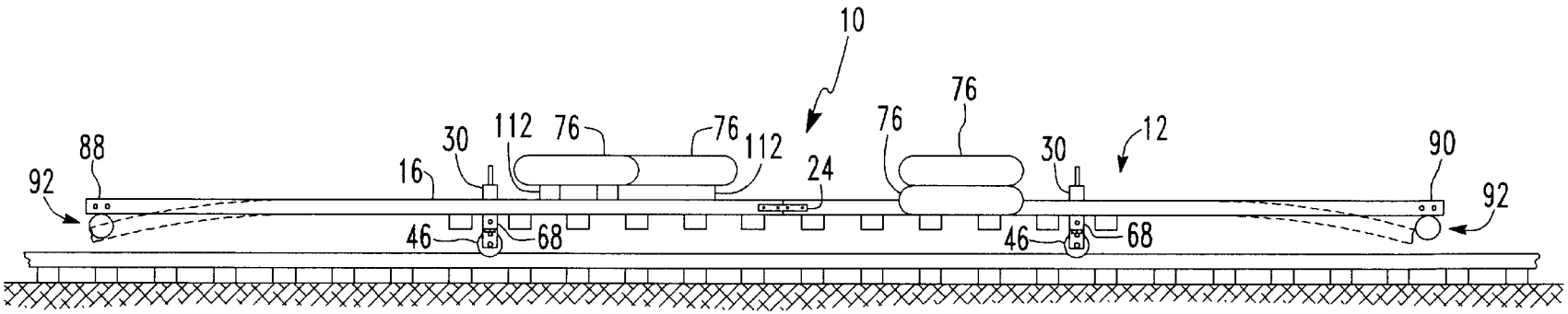
FIG. 3 is a side elevational view of a railway panel transport apparatus, illustrating the apparatus as it appears during transport on exiting railway track.
Figure 6:
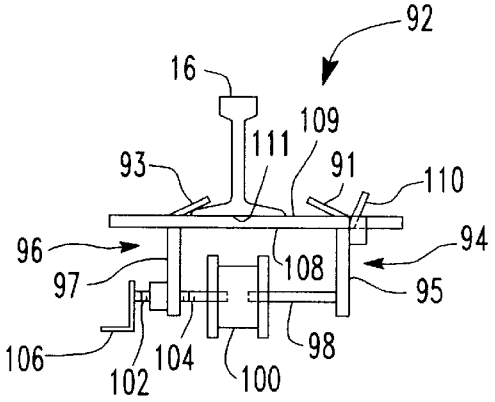
FIG. 6 is a front elevational view of a bogey wheel assembly used in the apparatus shown in FIG. 1, illustrating the method by which the assembly is mounted.

Depending upon the length of rail 16, rail ends 88 and 90 may sag during transport and come into contact with the transport surface. This effect is remedied by the use of bogey wheel assemblies 92 as seen in FIGS. 3 and 6. Bogey wheel assemblies 92 are clamped onto ends 88 and 90 of rail 16 during transport allowing ends 88 and 90 to roll along the transport surface without damaging rail 16. Bogey wheel assemblies 92 include opposing angled frame sections 94 and 96, which define angled sections 91 and 93, and depending sections 95 and 97, respectively. Extending transversely from the lower portion of section 95 is axle 98 upon which bogey wheel 100 is mounted. Free end 102 of axle 98 includes threaded portion 104 which extends through a correspondingly threaded opening in opposing frame section 97. Crank 106 is rigidly mounted to free end 102 of axle 98, so that upon rotation of crank 106, frame sections 94 and 96 are drawn toward each other.

Extending transversely through openings (not shown) in the upper end of sections 95 and 97 is bar 108, which is designed to maintain the correct spatial relationship between bogey wheel assembly 92 and rail 16, and to facilitate mounting bogey wheel assembly 92 thereto. Bar 108 is secured within the opening in section 97 in any suitable fashion, and is free to slide within the opening in section 95. The upper surface 109 of bar 108 contacts the base 111 of rail 16 to prevent vertical movement of the bogey wheel assembly 92 toward rail 16. Bar 108 extends through a hole (not shown) in the upper end of frame section 95 so that upon turning of crank 106, frame sections 94 and 96 are moved towards each other and base 111 of rail 16 becomes wedged between angled section 93 of frame 96 and bar 108 to mount bogey assembly 92 onto rail 16. Since axle 98 and crank 106 are located at the lower portion of bogey wheel assembly 92, it is necessary for bar 108 to be locked into position to prevent separation of the upper angled sections 91 and 93 of frames 94 and 96 of bogey wheel assembly 92 during transport. Locking is accomplished by a locking ring assembly 110 similar to that found on cabinet or bar clamps used in woodworking. Bar 108 extends through locking ring assembly 110 mounted on frame section 94. Locking ring assembly 110 is pivoted to allow bar 108 to slide through it and upon release of locking ring assembly 110, bar 108 is prevented from further movement.

As can be seen in FIGS. 2 and 3, several modifications of railway panel transport apparatus 10 are made during transport to facilitate efficient transport of the railway panel 12 and its corresponding materials. Rail 16 extends approximately ½ the length of railway panel 12 in front of and behind railway panel 12. Ties are not mounted to these sections of rail 16. The installation of railway panel 12 therefore requires additional ties. During transport the correct number of these additional railway ties 112 that are necessary to support the trailing end of rail 16 are mounted onto the top of railway panel 12 in any suitable fashion. The ties that are needed to support the leading section will have been installed with the panel 12 that is already in place. If the panel 12 is the first panel to be installed at the site, ties for both the leading and trailing ends may need to be provided. Prior to installation, these additional trailing ties 112 are removed from the top of railway panel 12 and positioned in proper alignment below rail 16. The leading end of rail 16 is positioned over trailing ties 112 placed during the installation of the preceding railway panel.

During transport along existing railway track, railway panel 12 is rolled solely on travel wheels 46 and 48. In these circumstances it is often desirable to remove mounting wheels 76 to facilitate transport since mounting wheels 76 extend below travel wheels 46 and 48 and may come into contact with the ground thereby disrupting travel. Mounting wheels 76 are removed from axles 74 and placed on the top of railway panel 12 during transport as can be seen in FIG. 3. When the end of the existing track is reached and it is necessary to the move railway panel transport apparatus 10 into position for installation, the mounting wheels 76 are removed from the top of railway panel 12 and placed back on axles 74 allowing railway panel transport apparatus 10 to be rolled off of the existing track and placed into the installation site.

When railway panel transport apparatus 10 has been finally positioned in the installation site and trailing ties 112 have been properly positioned, railway panel transport apparatus 10 is jacked up away from the ground and trucks 26 and bogey wheel assemblies 92 are removed leaving only railway panel 12 supported by jacks. The jacks are lowered and railway panel 12 is lowered into final position.

According to the provisions of the patent statutes, I have explained the principal, preferred construction and mode of operation of my invention and have illustrated and described what I now consider to represent its best embodiments. However, it should be understood that, within the scope of the appended claims, the invention may be practiced otherwise than as specifically illustrated and described.

I claim:

1. Apparatus for transporting railway panel sections comprising:

a railway panel having a plurality of ties, a first rail, and a second rail;

said first and second rails being fastened to the top of said ties in spaced parallel relation to each other;

at least one truck assembly removably mounted to said railway panel, said truck assembly including first and second travel wheels;

said travel wheels projecting below said railway panel, and being positioned to align with and roll along an existing railway track, to permit said assembly to roll therealong;

said truck assembly and said railway panel forming a wheeled vehicle that can travel along railroad track or over an untracked surface.

2. The apparatus recited by claim 1 wherein said truck assembly is clamped to said railway panel.

3. The apparatus recited by claim 1 wherein said truck assembly defines a clamp.

4. Apparatus for transporting railway panel sections comprising, a railway panel having a plurality of ties, a first rail, and a second rail, said ties being positioned in spaced parallel relationship for supporting said first and second rails, said first and second rails extending substantially the length of said railway panel, said first and second rails fastened to the top of said ties in spaced parallel relation substantially perpendicular to said ties, at least two truck assemblies removably mounted to said railway panel, said truck assemblies each having rotatably mounted first and second travel wheels, said travel wheels projecting below said railway panel, and said first and second travel wheels positioned to align with said first and second rails, respectively, for allowing said railway panel to be transported upon an existing railway track, said truck assemblies and said railway panel forming a wheeled vehicle that can travel along railroad track or over an untracked surface.

5. Apparatus for transporting railway panel sections comprising, a railway panel having a plurality of ties, a first rail, and a second rail, said ties being positioned in spaced parallel relationship for supporting said first and second rails, said first and second rails extending substantially the length of said railway panel, said first and second rails fastened to the top of said ties in spaced parallel relation substantially perpendicular to said ties, at least two truck assemblies, means for connecting said truck assemblies to said railway panel, said truck assemblies each having rotatable mounted first and second travel wheels, said travel wheels projecting below said railway panel, and said first and second travel wheels positioned to align with said first and second rails, respectively, for allowing said railway panel to be transported upon an existing railway track, said truck assemblies including, a truck tie positioned below said first and second rails and between two of said ties, a clamping tie positioned opposite of said truck tie on said first and second rails, first and second travel wheel brackets positioned below said truck tie opposite said first and second rails, respectively, and said first and second travel wheels being rotationally mounted in said first and second travel wheel brackets.

6. The railway panel transporting apparatus as set forth in claim 5 in which said connecting means includes, said truck tie having a plurality of vertical transverse holes, said clamping tie having a plurality of vertical transverse holes aligned with said truck tie vertical transverse holes, said travel wheel brackets having a plurality of vertical transverse holes aligned with said truck tie vertical transverse holes, a plurality of bolts, each bolt having two threaded ends, said bolts extending through said clamping tie vertical transverse holes, said truck tie vertical transverse holes, and said travel wheel bracket vertical transverse holes, a plurality of nuts, said nuts corresponding to said bolt threaded ends, and said nuts operable to clamp said clamping tie, said truck tie, and said travel wheel brackets together about said first and second rails.

7. The railway panel transporting apparatus as set forth in claim 6 which includes, said threaded ends being coarsely threaded to facilitate rapid assembly and removal of said nuts on said bolts.

8. A apparatus for transporting railway panel sections comprising, a railway panel having a plurality of ties, a first rail, and a second rail, said ties being positioned in spaced parallel relationship for supporting said first and second rails, said first and second rails extending substantially the length of said railway panel, said first and second rails fastened to the top of said ties in spaced parallel relation substantially perpendicular to said ties, at least two truck assemblies, means for connecting said truck assemblies to said railway panel, said truck assemblies each having rotatable mounted first and second travel wheels, said travel wheels projecting below said railway panel, and said first and second travel wheels positioned to align with said first and second rails, respectively, for allowing said railway panel to be transported upon an existing railway track, said first and second truck assemblies including, a pair of mounting wheels having a radius larger than the distance between said truck tie and the bottom of said first and second travel wheels, means for connecting said mounting wheels to said truck assemblies, and said mounting wheels having a surface for facilitating transport of said railway panels on non-rail surfaces.

9. The railway panel transporting apparatus as set forth in claim 8 in which said mounting wheel connecting means includes, a pair of axle clamps mounted onto opposite ends of said truck tie, said axle clamps having an end surface, an upper surface, a lower surface, a front surface, and a back surface, said axle clamps having a generally box-shaped configuration for fitting over said truck tie ends, said upper surfaces and said front surfaces each having a threaded hole therethrough, a plurality of pressure plates positioned between each of said upper and front surfaces and said truck tie opposite said threaded holes, a plurality of damping screws having a threaded portion corresponding to said threaded holes inserted into said threaded holes, said clamping screws each having a U-shaped tightening portion, said clamping screws operable upon rotation of said U-shaped tightening portion to clampingly engage said axle damp to said truck tie, said axle clamps each having an axle extending from and perpendicular to said end surface, said axle having a threaded end portion, said mounting wheel being mounted onto said axle, and a pair of axle nuts corresponding to said axle threaded end portions operable upon rotation to clampingly engage and release said mounting wheel to said axle clamp.

10. The railway panel transporting apparatus as set forth in claim 9 which includes, said axle clamp end surfaces each having a plurality of relatively short threaded bolts extending therefrom, a T-shaped kingpin having a plurality of holes therethrough, said T-shaped kingpin being mounted on said bolts through said holes by a plurality of correspondingly threaded nuts, said kingpin having a threaded end portion, said mounting wheels being mounted onto said axles, and a pair of axle nuts corresponding to said axle threaded end portions operable upon rotation to clampingly engage and release said mounting wheel to said axle clamp.

11. The railway panel transporting apparatus as set forth in claim 9 which includes, said axle threaded ends being coarsely threaded to facilitate rapid assembly and removal of said axle nuts on said axles.

12. Apparatus for transporting railway panel sections comprising, a railway panel having a plurality of ties, a first rail, and a second rail, said ties being positioned in spaced parallel relationship for supporting said first and second rails, said first and second rails extending substantially the length of said railway panel, said first and second rails fastened to the top of said ties in spaced parallel relation substantially perpendicular to said ties, at least two truck assemblies, means for connecting said truck assemblies to said railway panel, said truck assemblies each having rotatable mounted first and second travel wheels, said travel wheels projecting below said railway panel, and said first and second travel wheels positioned to align with said first and second rails, respectively, for allowing said railway panel to be transported upon an existing railway track, said railway panel transporting apparatus further including, said first rail having an extended front end and an extended back end, a pair of bogey wheel assemblies, and means for attaching said bogey wheel assemblies to said extended front and back ends.

13. The railway panel transporting apparatus as set forth in claim 12 in which said bogey wheel assembly attaching means comprises, a first frame section and a second frame section, each having a lower portion, and an upper portion, said first and second frame sections having opposing angular surfaces adjacent to said upper surfaces, a bogey wheel axle extending transversely from said lower portion of said first frame section, said bogey wheel axle having a threaded end portion, a bogey wheel mounted on said bogey wheel axle, said lower portion of said second frame section having a threaded hole corresponding to said threaded end portion of said bogey axle, said bogey axle extending through said threaded hole, a crank rigidly attached to said threaded end portion, said crank operable upon rotation to move said first and second frame sections towards each other, a bar transversely extending from said upper portion of said second frame section, said upper portion of said first frame section having a hole corresponding to said bar, said bar extending through said hole, said first frame section having a locking ring assembly operable to fix movement of said bar in said hole, and said locking ring assembly and said crank operable to clampingly engage said bogey wheel assembly to said extended rail front and back.

14. A method for installing prefabricated railway panels including the steps of, forming a wheeled vehicle with a railway panel and at least two truck assemblies by, aligning a plurality of ties in a spaced parallel relationship to form the railway panel, fastening a first rail perpendicular to the top of the ties, fastening a second rail to the top of the ties in spaced parallel relationship to the first rail, removably mounting the truck assemblies to the railway panel, and rotatably mounting a first pair of travel wheels to each of the truck assemblies to extend below the railway panel in vertical alignment with the first and second rails, respectively, positioning the travel wheels on a section of existing track, transporting the railway panel to an installation point, jacking up the railway panel, removing the truck assemblies, and lowering the railway panel into an installed position.

15. The method for installing prefabricated railway panels as set forth in claim 14 further including the step of, rotatably mounting a pair of mounting wheels to the truck assemblies.

16. The mood for installing prefabricated railway panels as set forth in claim 14 further including the step of, clamping mounting a bogey wheel assembly to extended front and back ends of the first rail.

* * * * *